US007074136B2

(12) United States Patent
Noguchi et al.

(10) Patent No.: US 7,074,136 B2
(45) Date of Patent: Jul. 11, 2006

(54) GOLF CLUB HEAD AND GOLF CLUB

(75) Inventors: Shuichi Noguchi, Osaka (JP); Shinichi Inukai, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/809,196

(22) Filed: Mar. 25, 2004

(65) Prior Publication Data

US 2004/0266551 A1 Dec. 30, 2004

(30) Foreign Application Priority Data

Mar. 27, 2003 (JP) ..... 2003-087874
Mar. 19, 2004 (JP) ..... 2004-080632

(51) Int. Cl.
*A63B 53/04* (2006.01)
*A63B 53/06* (2006.01)

(52) U.S. Cl. ..... 473/346; 473/350

(58) Field of Classification Search ..... 473/324–350
See application file for complete search history.

(56) References Cited

U.S. PATENT DOCUMENTS 5,419,559 A * 5/1995 Melanson et al. ..... 473/346
5,547,427 A * 8/1996 Rigal et al. ..... 473/345
5,624,331 A * 4/1997 Lo et al. ..... 473/345
5,839,975 A * 11/1998 Lundberg ..... 473/346
5,997,415 A * 12/1999 Wood ..... 473/346
6,183,377 B1 * 2/2001 Liang ..... 473/324
6,716,110 B1 * 4/2004 Ballow ..... 473/242
6,955,612 B1 * 10/2005 Lu ..... 473/324
2003/0083151 A1 * 5/2003 Nakahara et al. ..... 473/345
2005/0143189 A1 * 6/2005 Lai et al. ..... 473/335

FOREIGN PATENT DOCUMENTS

JP 6-86757 12/1994
JP 7-4050 2/1995
JP 08-196665 8/1996
JP 10146404 A * 6/1998
JP 2003-199848 7/2003

* cited by examiner

*Primary Examiner*—Eugene Kim
*Assistant Examiner*—Alvin A. Hunter, Jr.
(74) *Attorney, Agent, or Firm*—Troutman Sanders LLP; Gerald R. Boss, Esq.

(57) ABSTRACT

A golf club head includes: a head body including a crown portion having a plurality of openings, a face portion, a toe portion, a heel portion and a sole portion; a crown part mounted to the head body so as to close the openings, and a support portion provided between the openings for supporting the crown part. The support portion is X-shaped, for example.

10 Claims, 7 Drawing Sheets

GOLF CLUB HEAD AND GOLF CLUB

This nonprovisional application is based on Japanese Patent Applications Nos. 2003-087874 and 2004-080632 filed with the Japan Patent Office on Mar. 27, 2003 and Mar. 19, 2004, respectively, the entire contents of which are hereby incorporated by reference.

BACKGROUND OF THE INVENTION

1. Field of the Invention

The present invention relates to a golf club head and a golf club having a head body made with metal, and to a golf club head to which a crown part is fixed so as to close crown openings and a golf club having such a head.

2. Description of the Background Art

Recently, golf club heads are increasingly manufactured with larger volume, which results in higher center of gravity. A golf club head with such higher center of gravity may hardly raise a ball high when hitting it and may decrease the distance of the ball flight. Accordingly, various attempts have been made to set the center of gravity of a golf club head lower such that it easily raises the ball high and increases the distance of the ball flight.

For example, Japanese Patent Laying-Open No. 8-196665 describes a golf club head, in which a hosel portion is integrally formed, and a through hole penetrating through a vertical direction including the center of gravity of the head to form a ring-shaped head body. A closure plate made with a material smaller in the specific gravity and softer than the head body is secured or fixed to the head body, such that at least one of upper and lower openings of the through hole of the head body is closed.

Japanese Utility Model Publication No. 7-4050 describes a golf club head, in which, in order to provide a large and strong golf club head, a mass body is formed that serves as a framework of the club head by: an integral body of a face portion and a neck portion; a plurality of ribs provided from the back surface of the face portion to the rear end of the club head; and a fixing member for fixing the plurality of ribs at the rear end of the club head. Further, the space in the mass body is filled with a foam body to be a shape of a club head.

Japanese Utility Model Laying-Open No. 6-86757 describes a golf club head, wherein, in order to reduce the weight of the head, increase the strength of the face portion, increase the distance of the ball flight, and provide the player with a soft feeling on impact and easier control of the direction of the ball flight, a depression in the face portion in the head body is provided with a window-like opening having a shape and size accounting for weight distribution and the position of the center of gravity of the entire head at a predetermined position. Additionally, a face plate attached to the depression is formed with a composite material made with a plurality of layers of different strength and stiffness.

With the golf club head according to Japanese Patent Laying-Open No. 8-196665, as it is simply provided with the through hall penetrating through the head body in a vertical direction, the strength of the crown portion of the head body may disadvantageously be decreased even though the closure plate is fixed to the head body.

While Japanese Utility Model Publication No. 7-4050 describes provision of a plurality of ribs from the back surface of the face portion to the rear end of the club head, the ribs cannot reinforce the crown portion. Additionally, it does not disclose or suggest to apply the idea disclosed by the publication to the crown portion. As the ribs reach the back surface of the face portion, the face portion hardly deflects and the distance of the ball flight may disadvantageously be decreased.

With the golf club head according to Japanese Utility Model Laying-Open No. 6-86757, while the strength of the face portion may be improved, reinforcement of the crown portion cannot be achieved. Additionally, it does not disclose or suggest to apply the idea disclosed by the publication to the crown portion.

SUMMARY OF THE INVENTION

Accordingly, an object of the present invention is to provide a golf club head, with a crown part fixed to close crown openings and reinforcement of a crown portion is attained, and a golf club having such a head.

A golf club head according to the present invention, in one aspect, includes: a head body made with metal and including a crown portion having a plurality of openings; a crown part mounted to the head body so as to close the openings; and a support portion provided between the openings and supporting the crown part. A placing portion is provided around the openings for placing a peripheral portion of the crown part, and the support portion extends inwardly of the openings from the placing portion. When a plurality of openings are provided, the placing portion is provided to surround the plurality of openings.

As above, by providing the support portion supporting the crown part between the openings, the crown part can be reinforced by the support portion. As a result, the crown portion can be reinforced.

Preferably, the crown part is formed with a material smaller in specific gravity than a material forming the head body, and the crown part is adhered to the placing portion and the support portion.

Preferably, the placing portion and the support portion are arranged inwardly of the head body from the surface of the crown portion positioned around the placing portion and the support portion by at least 0.5 mm and at most 2.0 mm. Here, "the surface of the crown portion" refers to the surface of the crown portion that is not depressed.

Preferably, the support portion has a thickness of at least 0.7 mm and at most 1.2 mm, and a width of at least 3 mm and at most 15 mm, and more preferably, a width of at least 5 mm and at most 12 mm.

Preferably, the head body includes a sole portion, and a metal member greater in specific gravity than a material forming the head body is fixed to the sole portion.

Preferably, the support portion has a surface area of at least 250 $mm^2$ and at most 1000 $mm^2$. Preferably, the surface area of the support portion is smaller than the area of the openings, and the ratio between them is, for example, about 1:30–1:2. Preferably, an opening is provided to at least one of the support portion and the placing portion.

A golf club head according to the present invention, in another aspect, includes: a head body made with metal and including a face portion, a crown portion having a plurality of openings, a sole portion, a toe portion, and a heel portion; a crown part mounted to the head body so as to close the openings; a first support portion extending from a first end, being an end of the crown portion along the openings and positioned on the face portion side, continuously in a direction away from the face portion to define part of the openings and support the crown part; and a second support portion extending from a second end, being an end of the crown portion along the openings and positioned on the face portion side and closer to the heel portion side than the first end, continuously in a direction away from the face portion to define part of the openings and support the crown part. The first and second support portions extend in a diagonal direction crossing a face centerline, the face centerline being a virtual straight line passing a central portion of the face portion and extending in a direction perpendicular to a surface of the face portion. Preferably, the first and second support portions extend in different directions to be connected to each other.

A golf club head according to the present invention, in still another aspect, includes: a head body made with metal and including a face portion, a crown portion having a plurality of openings, a sole portion, a toe portion, and a heel portion; a crown part mounted to the head body so as to close the openings; and an X-shaped support portion extending from an end, being an end of the crown portion along the openings and positioned on the face portion side, continuously in a direction away from the face portion to define part of the openings and support the crown part.

A golf club head according to the present invention, in still another aspect, includes: a head body made with metal and including a face portion, a crown portion having four openings, a sole portion, a toe portion, and a heel portion; a crown part mounted to the head body so as to close the openings and formed with a material smaller in specific gravity than a material forming the head body; and first and second straight support portions provided to the crown portion so as to cross each other to define the four openings and support the crown part. A shape defined by the first and second support portions is symmetric relative to a face centerline, which is a virtual straight line passing a central portion of the face portion and extending in a direction perpendicular to a surface of the face portion, and when an end being an end of the crown portion along the openings and positioned on the face portion side is divided into first, second, third, and fourth areas in a direction from the toe portion toward the heel portion, the first support portion extends from an end of the crown portion positioned in the first or second area continuously in a direction away from the face portion, and the second support portion extends from an end of the crown portion positioned in the third or fourth area continuously in a direction away from the face portion. Preferably, an angle formed between a portion positioned on the face portion side in the first support portion and the face centerline is at least 40° and at most 50°, and an angle formed between a portion positioned on the face portion side in the second support portion and the face centerline is at least 40° and at most 50°.

A golf club according to the present invention includes the golf club head described above. Therefore, a golf club having a golf club head with a reinforced crown portion and high reliability can be obtained.

According to the present invention, as the support portion and the placing portion capable of supporting the crown part is provided at the opening of the crown portion, the crown portion can be reinforced. Thus, the reliability of the golf club head to which crown part is fixed can be improved.

Additionally, as the support portion such as the first and second support portions and the X-shaped support portion is provided to the crown portion, in addition to the reinforcement of the crown portion, deflection of the face portion toward the rear side when hitting a ball is allowed to some extent as the support portion extends diagonally on the face portion side. Thus, the bouncing or restitution characteristics can be maintained high. Additionally, provision of such a support portion increases the stiffness of the head and improves the sound thereof when hitting a ball. Further, providing the support portion extending diagonally, twisting distortion of the head when hitting a ball can effectively be suppressed. Thus, when hitting a ball, the direction of the ball flight can be stabilized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
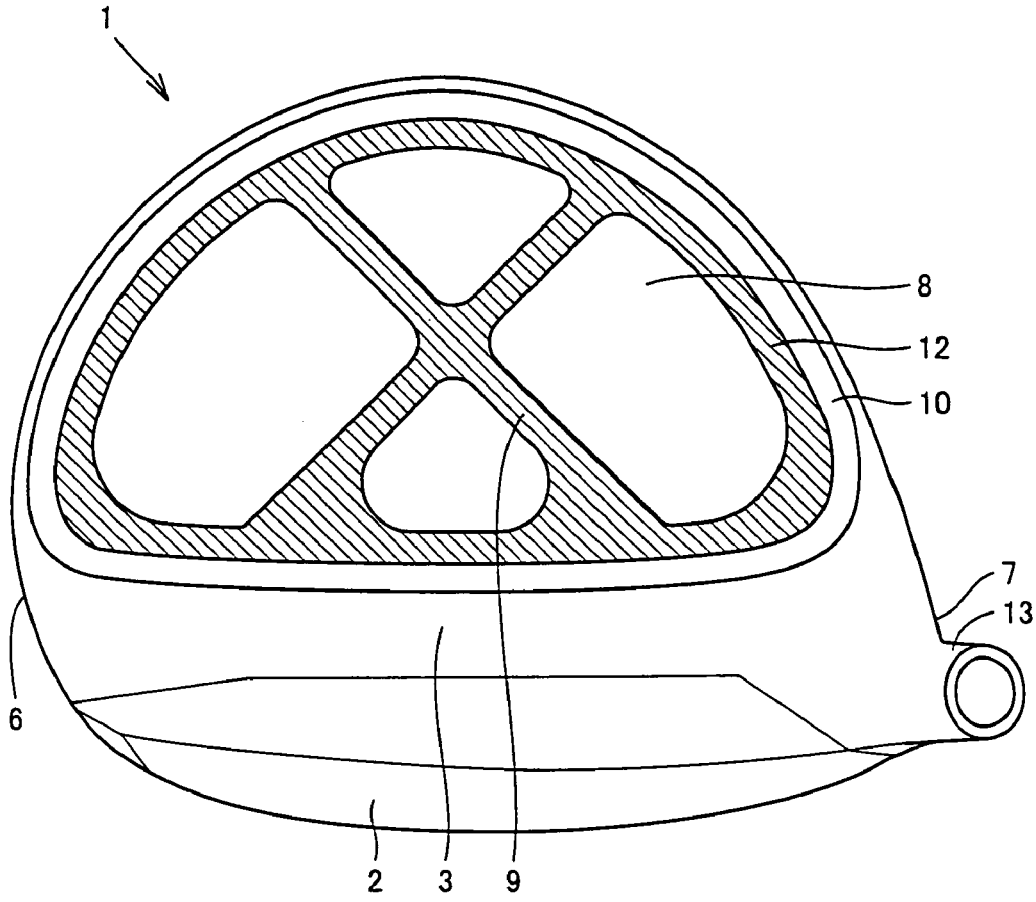
FIG. 1 is a plan view showing a golf club head according to Example 1 of the present invention from which a crown part is removed.

In the following, a golf club head and a golf club according to an embodiment of the present invention will be described. The idea of the present embodiment is useful to a wood golf club having a golf club head made with metal.

The golf club according to the present embodiment includes a golf club head described in the following, a shaft and a grip. The golf club head includes a face portion, a head body and a crown part. As for the shaft and the grip, well known components can be employed.

Typically, the face portion is formed as a part that is separate from the head body, and it is mainly formed with a metal such as titanium alloy. The face portion can be molded by forging, for example, and joined to the head body by welding.

The head body includes a crown portion, a sole portion, a side portion, a toe portion, and a heel portion, and mainly formed with a metal such as pure titanium or titanium alloy. The head body can be molded by casting, for example. The head body may be formed with a composite material including a material other than metal as well as a material of metal, or a composite material including different metals.

The crown portion of the head body is provided with an opening. The opening may be provided singularly or in a plurality of numbers. Providing the opening to the crown portion, the weight of the crown portion can be reduced and the center of gravity of the head can be set lower. It is preferable to fix a weight member, such as a metal member, higher in specific gravity than the material forming the head body, is fixed to the sole portion. This enables to set the center of the gravity of the head further lower.

The crown part is mounted to the head body so as to close the opening. Typically, the crown part is formed with a material lower in specific gravity than the material forming the head body. For example, when the head body is formed with pure titanium or titanium alloy, the crown part may be formed with a metal material of low specific gravity such as magnesium alloy, or a material of low specific gravity other than metal such as resin, plastic, rubber, a carbon material, or carbon fibers.

The above-mentioned crown part may be joined to the head body using an adhesive or a double-faced adhesive tape, for example. It may be fixed to the head body using other measures.

In the present embodiment, the support portion for supporting the above-mentioned crown part is provided to the opening of the crown portion. The support portion is provided so as to connect ends of the crown portion defining the above-mentioned opening, for example. Thus, the opening can be divided into a plurality of areas, resulting in a plurality of openings provided to the crown portion. Here, the support portion exists between the openings.

The support portion may be straight or may be curved. A plurality of the support portions may be provided, and the support portions may be connected to one another at the central portion of the opening of the crown portion or in the vicinity thereof.

The shape of the overall support portions may be selected arbitrary. For example, it may be selected to be a symmetrical shape relative to a sole centerline or a face centerline (a virtual straight line passing the central portion of the face portion and extending in a direction perpendicular to a surface of the face portion). Specifically, the support portions may be an X-shaped or cross-shaped support portion.

The support portion may be provided so as to extend inwardly of the opening from the end of the crown portion defining the opening. Here, the end of the support portion may be connected to one another as discussed above. The end of the support portion may also be separated from the opposing end of the crown portion. When the end of the support portion is separated from the opposing end of the crown portion, the free end (tip) of the support portion is disposed inside the opening, thus resulting in one opening provided to the crown portion.

A plurality of support portions may be projected inwardly of the opening from the end of the crown portion defining the opening, without connecting their ends to one another. This also results in one opening without disconnection provided to the crown portion.

The support portion may include: a first support portion extending from a first end, which is an end of the crown portion along the openings and positioned on the face portion side, continuously in a direction away from the face portion to define part of the openings and support the crown part; and a second support portion extending from a second end, which is an end of the crown portion along the openings and positioned on the face portion side and closer to the heel portion side than the first end, continuously in a direction away from the face portion to define part of the openings and support the crown part. Typically, the first and second support portions extend in a diagonal direction crossing the face centerline.

While the first and second support portions may extend in different directions separated from each other, preferably they are connected to each other. Additionally, the first and second support portions may be straight or may be curved.

For example, by shaping the first and second support portions straight and connected to each other in the crown portion, the above-mentioned X-shaped support portion can be formed. It is noted that, in order to ensure a certain amount of deflection of the face portion in the rear direction (toward the back portion of the head) when hitting a ball, at least the portion of the support portion closer to the face portion may extend in a diagonal direction crossing the face centerline. Therefore, the support portion may be formed in various shapes other than X-shape, such as V-shape, Y-shape, substantially X-shape, substantially V-shape, substantially Y-shape, and combinations of X, V and Y-shapes. Further, when the support portion is V or Y-shaped as it is preferable to provide a plurality of support portions extending diagonal directions on the face portion side, preferably two branching ends of the support portion are connected to the end of the crown portion along the openings and positioned on the face portion side.

When the support portion is X-shaped, four openings are formed in the crown portion. When the X-shaped support portion is structured with two straight first and second support portions, preferably the shape defined by the first and second support portions is symmetric relative to the face centerline.

Preferably, the angle formed between a portion positioned on face portion side in the first support portion and the face centerline is at least 40° and at most 50°, and an angle formed between a portion positioned on the face portion side in the second support portion and the face centerline is at least 40° and at most 50°. Thus, the support portions enable to increase the stiffness of the head body substantially equally in both of a face-back direction from the face portion to the back portion of the head, and a toe-heel direction from the toe portion to the heel portion of the head.

Preferably, when an end, which is an end of the crown portion along the openings and positioned on the face portion side, is divided into first, second, third, and fourth areas in a direction from the toe portion toward the heel portion, the first support portion extends from an end of the crown portion positioned in the first or second area continuously in a direction away from the face portion, and the second support portion extends from an end of the crown portion positioned in the third or fourth area continuously in a direction away from the face portion.

Providing such a support portion, the crown part can be reinforced. Thus, for example when an external force impacts on the crown part, distortion or break of the crown part can be avoided. Hence, the crown portion can be reinforced.

Additionally, as the support portion extends diagonally to the sole centerline or the face centerline, the deflection of the face portion toward the rear side (the face-back direction) when hitting a ball can be allowed to some extent. Thus, the bouncing or restitution characteristics of the head can be maintained high, while the stiffness of the head itself can be increased and the sound thereof when hitting a ball can be improved. Further, providing the support portion extending diagonally, twisting distortion or deformation of the head when hitting a ball can effectively be suppressed. Thus, the direction of the ball flight can be stabilized.

Preferably, the above-mentioned support portion is fixed to the crown part. Here, the fixed area of the crown part can be increased, whereby the crown part can be strongly fixed to the head body.

As discussed above, when the support portion is provided integrally with the head body so as to connect the ends of the crown portion defining the opening, distortion or deformation of the head body, for example when the head body is molded by casting, can be avoided. Thus, adhesion precision with the crown part can be improved, and fixation strength of the crown part against impact force from various directions can be improved. Additionally, provision of the crown part avoids an unnecessary step in the crown portion, and the surfaces of the crown portion and the crown part can be formed at substantially the same level. Accordingly, the appearance of the head can also be improved.

Further, by leaving the support portion bridging over the opening, the distortion or deformation amount of the head body resulted from heating the head body, for example when the head body and the face portion are welded, can be decreased.

When a plurality of support portions are provided so as to divide the opening of the crown portion in a plurality of areas, to connect the ends of the crown portion defining the opening, and to extend in directions crossing one another to be coupled at the central portion of the crown portion, the crown portion can be reinforced and distortion or deformation of the head body can be avoided. Additionally, reverberation after hitting a ball of high audio frequencies that is generally comfortable to golfers can be obtained. Specifically, such an effect may fully be attained by forming the support portions symmetrically.

Preferably, a placing portion is provided to the end of the crown portion so as to surround the openings for placing peripheral portion of the crown part. Here, the support portion locally extends inwardly of the openings from the placing portion. Preferably, the crown part is adhered to both the placing portion and the support portion. Thus, the crown part can strongly be fixed to the head body.

Preferably, the placing portion and the support portion are provided to the crown portion in a depressed manner. Specifically, the placing portion and the support portion are arranged inwardly of the head body (on the sole portion side) from the surface of the crown portion by at least 0.5 mm and at most 2.0 mm.

As the crown part is provided on the placing portion and the support portion, preferably the offset amount (depression amount) of the placing portion and the support portion from the surface (upper face) of the crown portion except for the depressed or concave portion positioned around the placing portion is set substantially equal to the thickness of the crown part. Thus, formation of a step between the surface (upper face) of the crown part and the surface of the crown portion can be prevented.

However, as a step of a certain amount between the surfaces of the crown part and the crown portion may not significantly be disadvantageous in the appearance, if the step is not excessively great, the offset amount can be different from the thickness of the crown part.

The crown portion may be provided with a stepped portion such that further depressed or concave portion is formed around the placing portion. Specifically, a stepped portion may be provided on the outer peripheral side of the crown portion from the depressed placing portion with a space interposed, to form a concave portion continuously extending from the placing portion toward the outer periphery of the crown portion. Here, the outer periphery of the crown part is arranged within the depressed portion in order to ensure a gap between the outer periphery of the crown part and the wall of the stepped portion. Provision of such a stepped portion ensures fixation of the crown part to the crown portion even when the outer shape of the crown part varies.

In order to ensure the strength of the crown part, preferably the thickness of the crown part is at least 0.5 mm. In order not to produce a head having high center of gravity due to excessive weight of the crown part, preferably the thickness of the crown part is at most 2.0 mm. Thus, as discussed above, the offset amount of the placing portion and the support portion from the surface of the crown portion is set at least 0.5 mm and at most 2.0 mm.

Preferably, the thickness of the support portion is at least 0.7 mm and at most 1.2 mm, approximately. The thickness of the support portion is set to at least 0.7 mm since castability is impaired when the head body is produced by casting if the thickness is less than 0.7 mm, which may hinder to mold the support portion with high precision. The thickness of the support portion is set to at most 1.2 mm in order not to hinder to set the center of gravity of the head lower, due to excessive weight of the support portion.

Preferably, the width of the support portion is at least 3 mm and at most 15 mm, and more preferably, at least 5 mm and at most 12 mm. The width of the support portion is set to at least 3 mm since castability is impaired when the head body is produced by casting if the thickness is less than 3 mm, which may hinder to mold the support portion with high precision. The width of the support portion is set to at most 15 mm in order not to hinder to set the center of gravity of the head lower, due to excessive weight of the support portion.

Preferably, the support portion has a surface area of at least 250 $mm^2$ and at most 1000 $mm^2$, and more preferably, at least 300 $mm^2$ and at most 800 $mm^2$. By setting the surface area of the support portion in this range, the crown part can effectively be reinforced and the adhesion area of the crown part can be ensured. On the other hand, in order to set the center of gravity of the head lower, preferably the surface area of the support portion is smaller than the area of the openings. For example, the ratio between the surface area of the support portion and the area of the openings is approximately 1:30–1:2, and preferably approximately 1:20–1:5.

Preferably, an opening is provided to at least one of the support portion and the placing portion. While the shape of the opening is arbitrary selected, it may be a circular shape such as a circle or an oval, for example. The diameter or the maximum diameter of the opening is preferably at most ½ of the width of the support portion. Thus, the support portion may not excessively be decreased in its strength.

Provision of such an opening reduces the weight of the support portion, and sets the center of gravity of the golf club head further lower. Additionally, provision of the opening controls the strength of the support portion, enabling to obtain the support portion of desired strength. Appropriate adjustment of the diameter or the maximum diameter of the opening enables to leave an adhesive over the opening and to ensure the adhesion strength of the crown part. It is also possible to provide a depression to at least one of the support portion and the placing portion instead of the opening.

While the support portion discussed above is typically fixed with the crown part, it is also possible not to intentionally fix the support portion with the crown part. Additionally, a gap between the support portion and the crown part may intentionally be provided. Such an intentional provision of the gap between the crown part and the support portion ensures a clearance even when the shape of the support portion or the crown part varies, and therefore the crown part can be mounted to the head body and the yield can be improved.

In the following, examples of the present invention will be described referring to FIGS. 1–10.

EXAMPLE 1

First, referring to FIGS. 1–3 and FIGS. 6–8, Example 1 of the present invention and the variation thereof will be described. A golf club according to Example 1 includes a golf club head 1 shown in FIG. 1, a shaft and a grip. As the shaft and the grip, well-known components are employed.

Figure 2:
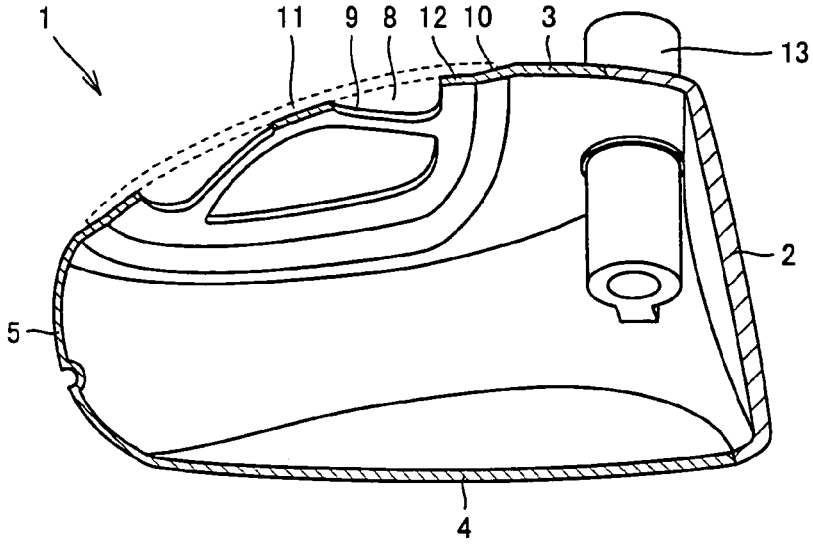
FIG. 2 is a cross-sectional view of the golf club head of FIG. 1.

As shown in FIGS. 1 and 2, golf club head 1 includes a face portion 2, a head body, a crown part 11, and a hosel portion 13. Face portion 2 is formed with titanium alloy, and joined with the head body by welding.

The head body includes a crown portion 3, a sole portion 4, a side portion 5, a toe portion 6, and a heel portion 7, and formed with titanium alloy containing 6 wt % of Al (aluminum) and 4 wt % of V (vanadium). The head body is molded by casting. The thickness of crown portion 3 positioned on the back portion side, which is away from face portion 2, is about 0.9 mm, and the thickness of crown portion 3 positioned on face portion 2 side is about 1.4 mm, the thickness of sole portion 4 is about 1.6 mm, and the thickness of side portion 5 is about 1.0 mm.

Figure 8:
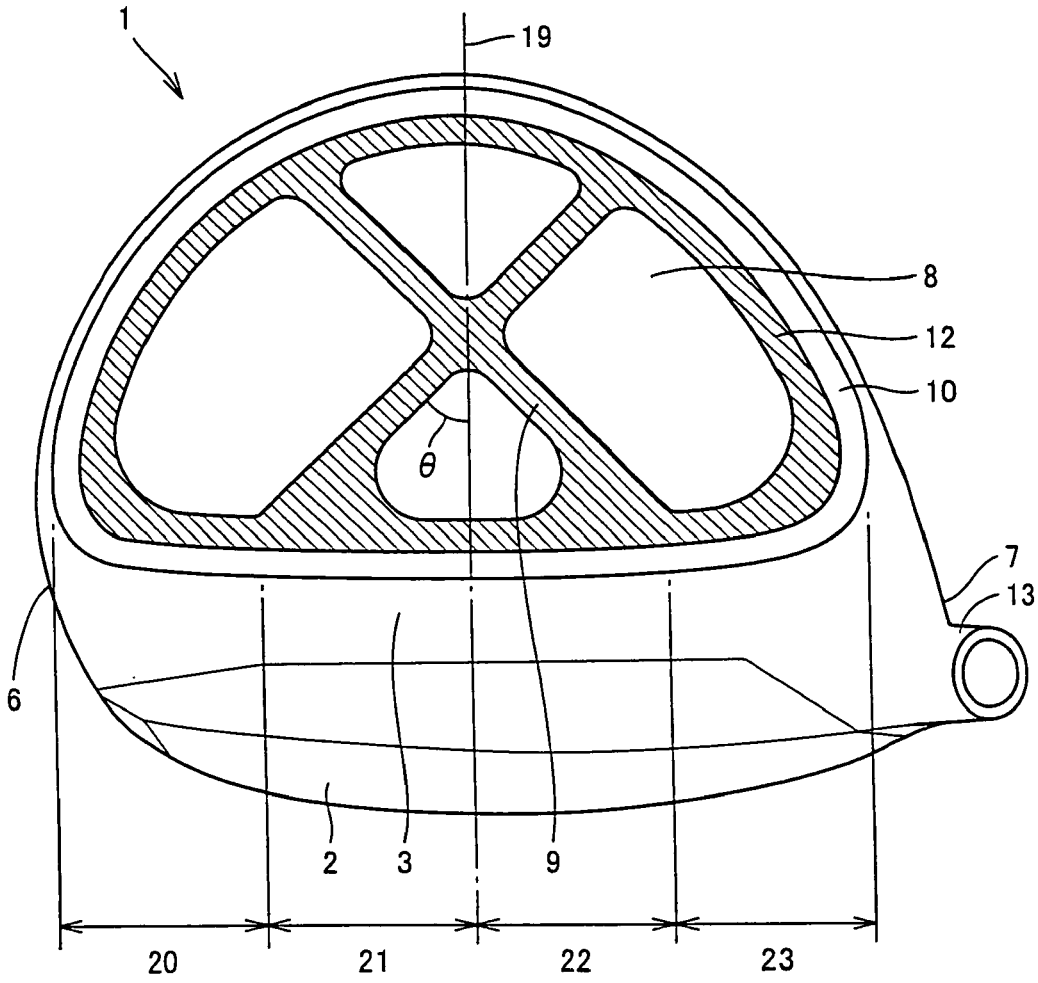
FIG. 8 is a plan view related to a description of characteristics of the support portion of the golf club head according to Example 1 of the present invention.

Crown portion 3 of the head body according to Example 1 is provided with four openings 8. As shown in FIG. 8, openings 8 are symmetric relative to a sole centerline or face centerline 19. Surrounding openings 8, a concave and ring-shaped placing portion 12 is provided, and a stepped portion 10 is provided so as to provide a concave portion around placing portion 12.

As shown in FIG. 2, placing portion 12 and stepped portion 10 are both arranged inwardly of the head portion (on the sole portion side) from the surface of crown portion 3 surrounding them. Crown part 11 is fixed to the head body so that periphery of crown part 11 extends above stepped portion 10 from above placing portion 12. Crown part 11 is formed with a carbon material.

As shown in FIG. 1, according to Example 1, an X-shaped support portion 9 is provided to form four openings 8 in crown portion 3. Support portion 9 extends from placing portion 12 inwardly of openings 8. Crown part 11 is fixed to support portion 9 and the bottom surfaces of placing portion 12 and stepped portion 10 using an adhesive.

Now, referring to FIG. 8, the shape of support portion 9 according to Example 1 will be described in further detail.

As shown in FIG. 8, an angle θ formed between the portion positioned on face portion 2 side in one straight support portion (a first support portion) 9 and face centerline 19 is 45°, while the angle formed between the portion positioned on face portion 2 side in the other straight support portion (a second support portion) 9 and face centerline 19 is also 45°.

Additionally, as shown in FIG. 8, when an end, which is an end of crown portion 3 along the opening and positioned on the face portion 2 side is divided into first, second, third, and fourth areas 20–23 in a direction from toe portion 6 toward heel portion 7, one support portion 9 extends from an end of crown portion 3 positioned in second area 21 continuously in a direction away from face portion 2, and the other support portion 9 extends from an end of crown portion 3 positioned in third area 22 continuously in a direction away from face portion 2.

According to Example 1, support portion 9 has a surface area of 713 $mm^2$ and the ratio between the surface area of support portion 9 and the area of openings 8 is 1:4.

As shown in FIG. 2, preferably a gap is provided between the outer periphery of crown part 11 and the wall of the stepped portion 10. Thus, variations in the outer shape of the crown part may be allowable.

The bottom surface of stepped portion 10, placing portion 12 and support portion 9 are arranged inwardly of the head body (on the sole portion side) by about 0.9 mm from the surface of crown portion 3. Here, the thickness of crown part 11 is also set to about 0.9 mm. Thus, as shown in FIG. 2, the surface of crown portion 3 around stepped portion 10 and that of crown part 11 can be formed at substantially the same level (coplanar). It is noted that the thickness of support portion 9 is about 0.9 mm, while the width thereof is about 5 mm.

Provision of support portion 9 as discussed above enables to reinforce crown portion 3, and crown part 11 can strongly be fixed to the head body. Additionally, it was found that the sound of the club when hitting a ball could also be improved, which will be discussed below referring to FIGS. 6 and 7.

Specifically, a comparison test of the sound of a golf club head when hitting a ball (a hitting sound) was conducted between a head provided with X-shaped support portion 9 of FIG. 1 and a head of the type shown in FIG. 1 but without X-shaped support portion 9. The result is shown in FIGS. 6 and 7.

Figure 6:
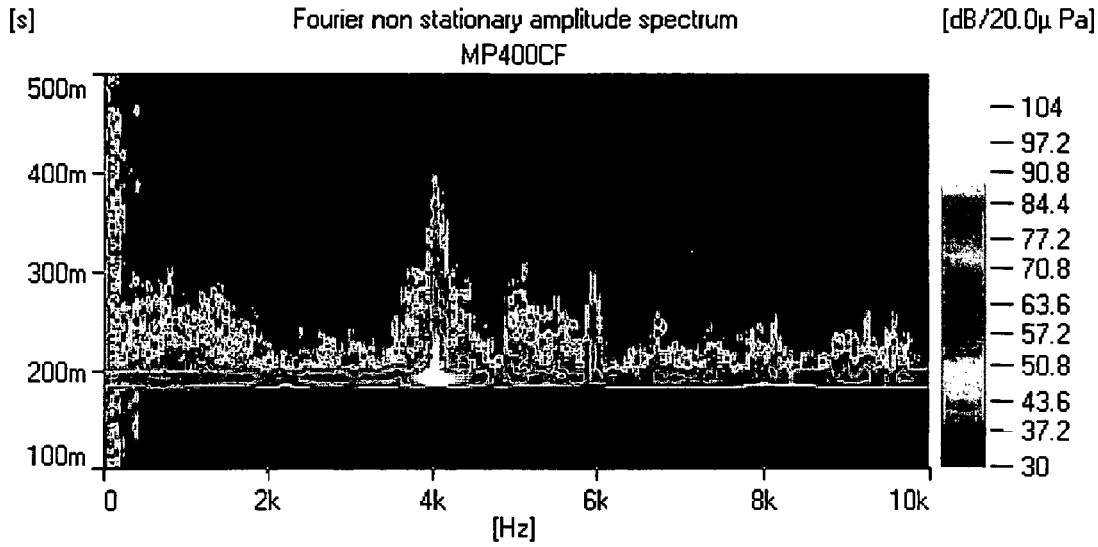
FIG. 6 is a sound analysis diagram analyzing the sound of a golf club head of the type according to Example 1 without an X-shaped support portion, when hitting a ball.
Figure 7:
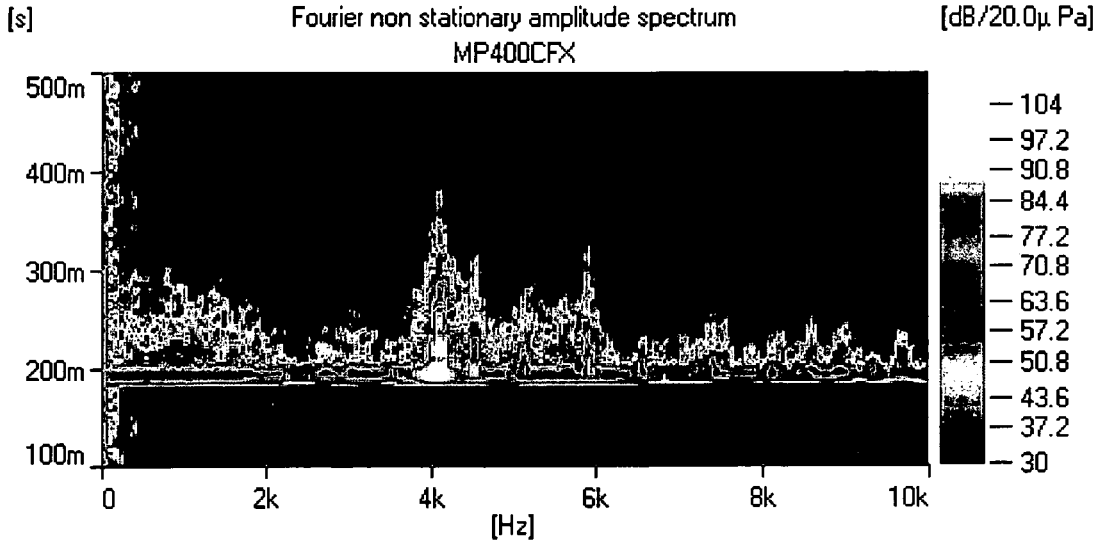
FIG. 7 is a sound analysis diagram analyzing the sound of the golf club head according to Example 1 when hitting a ball.

FIG. 6 is the sound analysis diagram where support portion 9 is not provided, while FIG. 7 is the sound analysis diagram where support portion 9 is provided. In each of FIGS. 6 and 7, the axis of ordinate indicates the time length (ms) of a hitting sound, while the axis of abscissa indicates the frequency of a hitting sound.

The present hitting sound comparison test was conducted by connecting a microphone "product name: condenser microphone 4165" available from Brüel & Kjær to a microphone power supply "product name: type 2804 microphone power supply" available from Brüel & Kjær, and recording the hitting sounds with a DAT recorder "product name: DA-P20" available from TEAC Corporation. The analysis of sounds was conducted calibrating with 1 kHz and 94 dB signals using software "product name: type 7698 sound quality software" available from Brüel & Kjær, for the hitting sound data for 0.2 seconds before hitting a ball and after 0.8 seconds after hitting the ball, i.e., 1.0 second in total.

As shown in each of FIGS. 6 and 7, a steep rise is indicated around 4 (kHz), which indicates the sound produced from sole portion 4, while a steep rise around 6 (kHz) indicates the sound produced from crown portion 3.

By comparing the sound produced from crown portion 3 between FIGS. 6 and 7, while the length of the sound with the golf club head without X-shaped support portion 9 is about 300 (ms), the length of the sound with the golf club head with X-shaped support portion 9 is about 350 (ms). This shows that reverberation is longer in high audio frequencies with X-shaped support portion 9. This reverberation in high audio frequencies is the sound comfortable to golfers, which is attained by provision of X-shaped support portion 9.

It is noted that, irrespective of provision of X-shaped support portion 9, the frequency (6 kHz) of the sound produced from crown portion 3 shows the value 1.5 times higher than the frequency (4 kHz) of the sound produced from the sole portion, which is a consonance comfortable to people.

The inventors of the present invention conducted a comparison test of backspin amount of a ball after hit between a head provided with X-shaped support portion 9 of FIG. 1 and a head of the type shown in FIG. 1 but without X-shaped support portion 9. The test result is discussed referring to FIG. 10.

For the test, a golf club with a head provided with X-shaped support portion 9 of FIG. 1 and a golf club with a head of the type shown in FIG. 1 but without X-shaped support portion 9 were prepared. The golf clubs were attached to a golf swing robot to hit balls, and the initial velocity and the spin amount were measured.

Figure 10:
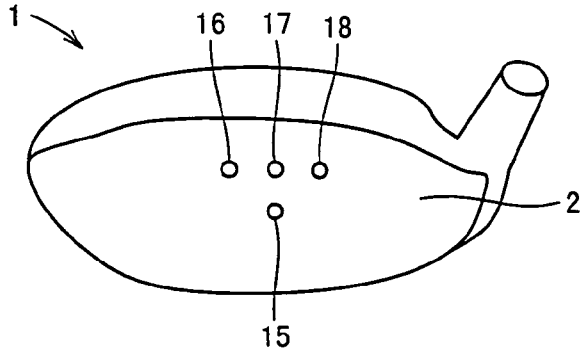
FIG. 10 is a schematic illustration of a golf club head 1 related to a description of hitting positions.

In the present robot test, the initial velocity and the spin amount were measured hitting the balls at hitting positions 15–18 of golf club heads as shown in FIG. 10. Hitting position 15 is the face center position, hitting position 16 is the position 5 mm above and 5 mm left the face center, hitting position 17 is the position 5 mm above the face center, and hitting position 18 is the position 5 mm above and 5 mm right the face center. The length of the golf club is 44.5 inches, while the club balance is D0.

Tables 1 and 2 below show the result of the robot test.

TABLE 1

| | Hitting position: the center | Hitting position: 5 mm above the center |
|---|---|---|
| < When VH 42.5 m/s > | | |
| Ball initial velocity with X frame (m/s) | 61.63 | 61.40 |
| Ball initial velocity without X frame (m/s) | 60.86 | 60.78 |
| Difference in initial velocity (m/s) | 0.77 | 0.62 |
| < When VH 46 m/s > | | |
| Ball initial velocity with X frame (m/s) | 66.70 | 66.10 |
| Ball initial velocity without X frame (m/s) | 65.60 | 64.81 |
| Difference in initial velocity (m/s) | 1.10 | 1.29 |

As shown in Table 1, in both cases where head speed (VH) is 42.5 m/s and 46 m/s, the initial velocity of the ball being hit is faster when hit with the head provided with X-shaped support portion 9. It is also found that the faster head speed results in greater difference between initial velocities of the balls. Specifically, when the head speed is fast and the ball is hit at the position above the face center, the difference between initial velocities of the balls depending on the existence of X-shaped support portion 9 becomes greater. Hence, it is found that provision of X-shaped support portion 9 reduces the energy loss when hitting a ball.

As shown in Table 2, it is found that provision of X-frame (X-shaped support portion 9) reduces variations (standard deviation) in the spin amount when hitting balls at hitting positions 16–18. It is also found that when X-frame (X-shaped support portion 9) is provided, the average value of spin amounts at hitting positions 16–18 are 1602 rpm–1715 rpm, while when X-frame (X-shaped support portion 9) is not provided, the average value of spin amounts at hitting positions 16–18 are 1398 rpm–1689 rpm, and therefore provision of X-frame (X-shaped support portion 9) reduces the difference in spin amounts of the balls depending on the hitting positions. Hence, provision of X-frame (X-shaped support portion 9) reduces variations in spin amounts of the balls when hitting balls at the positions except for the face center (offset hitting), stabilizing the distance and the trajectory of the ball flight.

Figure 3:
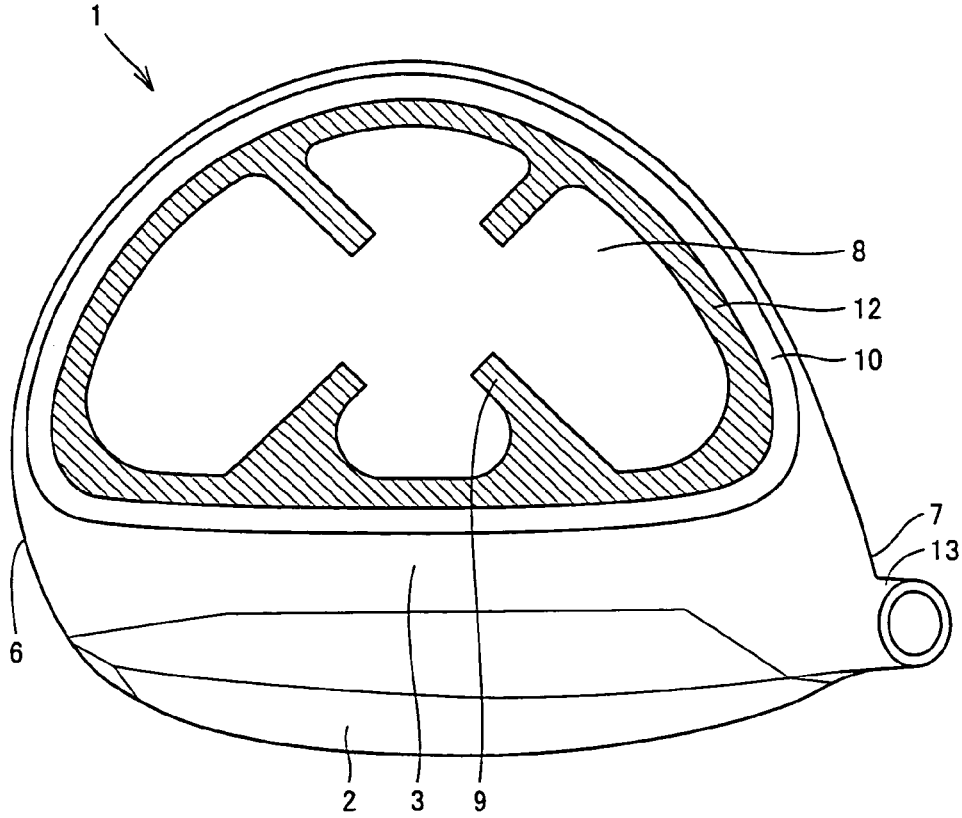
FIG. 3 is a plan view showing a golf club head according to a variation of Example 1 of the present invention from which a crown part is removed.

Next, a variation example of the head according to Example 1 will be described referring to FIG. 3. As shown in FIG. 3, the central portion of support portion 9 may be removed such that support portions 9 are provided separately. Thus, openings are connected to one another at the central portion of crown portion 3 to be substantially one opening 8. The rest of the structure is basically similar to the example discussed above.

EXAMPLE 2

Next, Example 2 will be described referring to FIGS. 4 and 5.

Figure 4:
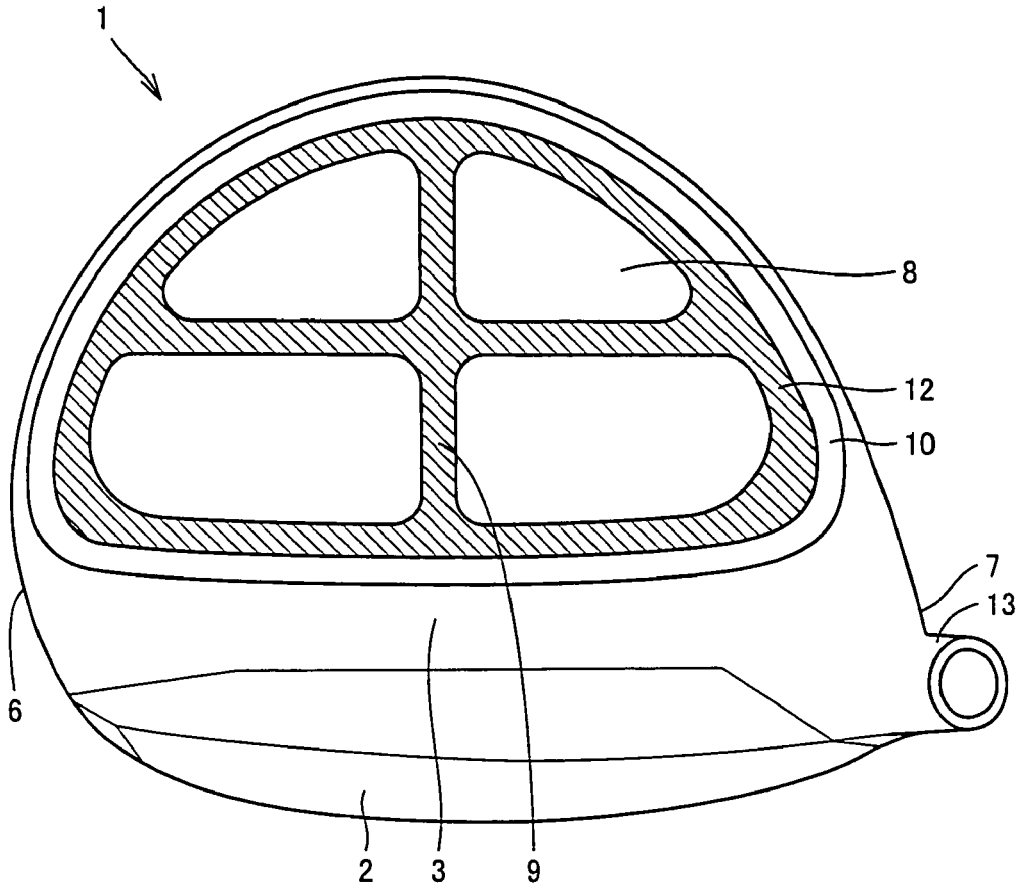
FIG. 4 is a plan view showing a golf club head according to Example 2 of the present invention from which a crown part is removed.
Figure 5:
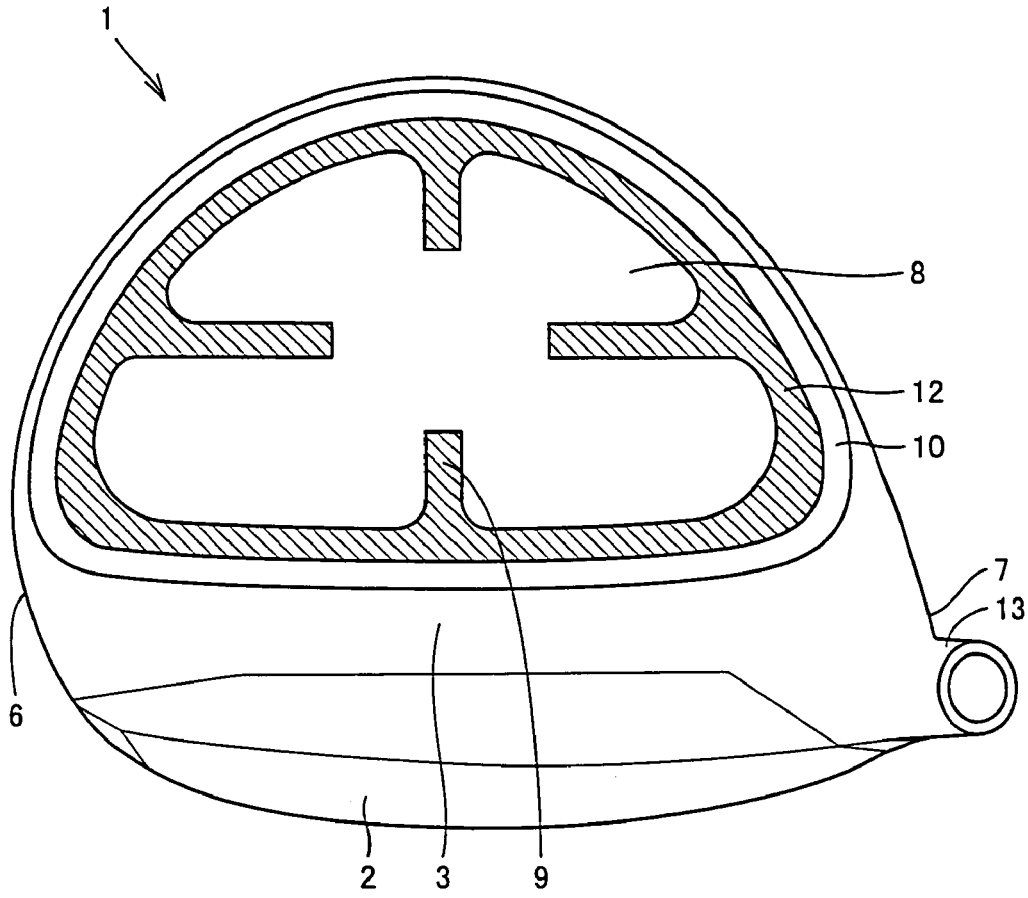
FIG. 5 is a plan view showing a golf club head according to a variation of Example 2 of the present invention from which a crown part is removed.

As shown in FIG. 4, support portion 9 may be cross-shaped. Additionally, as shown in FIG. 5, the central portion of support portion 9 may be removed such that support portions 9 are provided separately. In this case also, openings are connected to one another at the central portion of crown portion 3 to be substantially one opening 8. The rest of the structure is basically similar to the example shown in FIG. 4.

EXAMPLE 3

Next, Example 3 will be described referring to FIG. 9.

Figure 9:
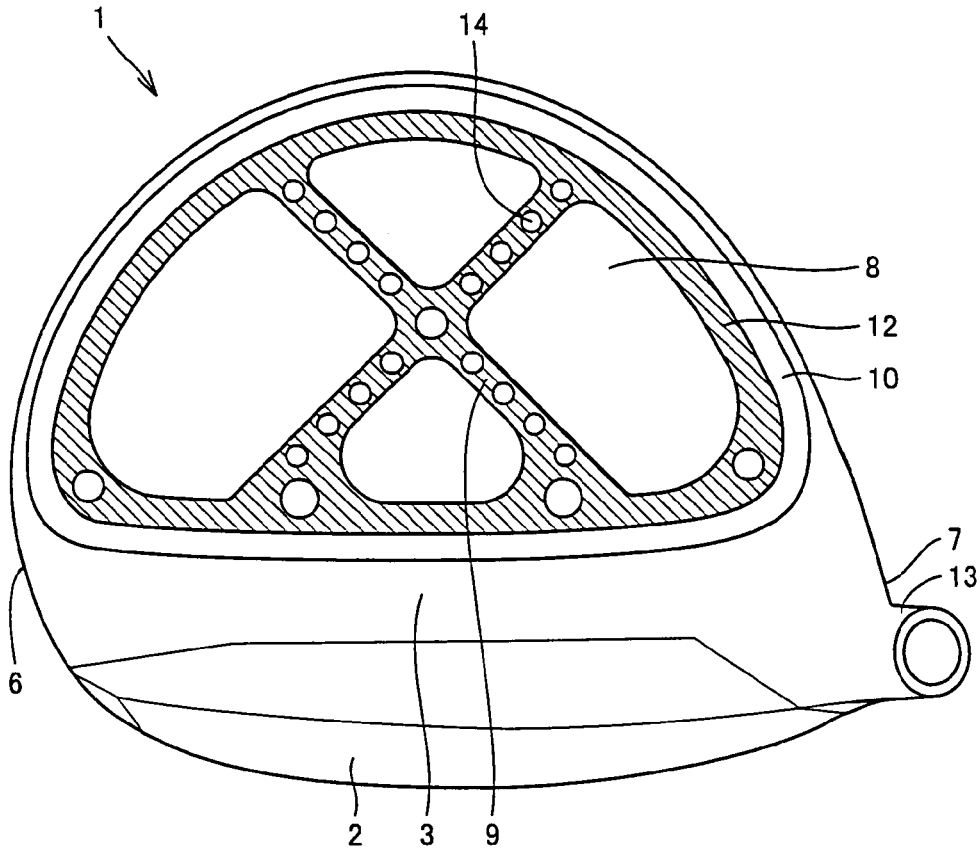
FIG. 9 is a plan view showing a golf club head according to Example 3 of the present invention from which a crown part is removed.

As shown in FIG. 9, according to Example 3 circular openings 14 are provided to support portion 9 and placing portion 12. While substantially the entire of support portion 9 is provided with openings 14 with uniform intervals,

TABLE 2

| | Hitting position: 5 mm above the center Backspin amount (cpm) | | Hitting position: 5 mm above and 5 mm left the center Backspin amount (cpm) | | Hitting position: 5 mm above and 5 mm right the center Backspin amount (cpm) | |
|---|---|---|---|---|---|---|
| | With X frame | Without X frame | With X frame | Without X frame | With X frame | Without X frame |
| | 1634 | 1632 | 1735 | 1618 | 1750 | 1219 |
| | 1584 | 1706 | 1580 | 1284 | 1666 | 1265 |
| | 1670 | 1458 | 1716 | 1564 | 1614 | 1390 |
| | 1605 | 1835 | 1653 | 1392 | 1766 | 1334 |
| | 1513 | 1692 | 1713 | 1523 | 1791 | 1629 |
| | 1513 | 1680 | 1551 | 1524 | 1764 | 1460 |
| | 1693 | 1823 | 1572 | 1425 | 1652 | 1486 |
| Average value | 1602 | 689 | 1646 | 1476 | 1715 | 1398 |
| Standard deviation | 70.83 | 126.66 | 77.69 | 114.70 | 69.01 | 140.73 |

placing portion 12 is provided with openings 14 at the portion only on face portion 2 side. The diameter of each opening 14 provided in placing portion 12 is greater than that provided in support portion 9. The rest of the structure is similar to the example shown in FIG. 1.

In the foregoing, while the embodiment and the examples of the present invention have been described, combinations thereof have also been inherently contemplated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf club head comprising:

a head body made with metal and including a crown portion having a plurality of openings;

a crown part formed of a material smaller in specific gravity than a material forming the head body adapted to close said openings;

a support portion provided between said openings and supporting said crown part; and a placing portion provided around said opening for mounting a peripheral portion of said crown part, wherein said support portion extends inwardly of said openings from said placing portion, the support portion and placing portion are below the surface of the crown portion, and said crown part is adhered to said placing portion and said support portion and crown part completely covers said support portion.

2. The golf club head according to claim 1, wherein said placing portion and said support portion are arranged inwardly of said head body from a surface of said crown portion positioned around said placing portion and said support portion by at least 0.5 mm and at most 2.0 mm.

3. The golf club head according to claim 1, wherein said support portion has a thickness of at least 0.7 mm and at most 1.2 mm, and a width of at least 3 mm and at most 15 mm.

4. The golf club head according to claim 1, wherein said head body includes a sole portion, and a member greater in specific gravity than a material forming said head body is fixed to said sole portion.

5. The golf club head according to claim 1, wherein said support portion has a surface area of at least 250 $mm^2$ and at most 1000 $mm^2$.

6. The golf club head according to claim 1, wherein a ratio between a surface area of said support portion and an area of said openings is 1:30–1:2.

7. The golf club head according to claim 1, wherein an opening is provided to at least one of said support portion and said placing portion.

8. A golf club comprising the golf club head according to claim 1.

9. A golf club head comprising:

a head body made with metal and including a crown portion having a plurality of openings, a sole portion, a toe portion, and a heel portion;

a crown part formed of a material smaller in specific gravity than a material forming the head body mounted to said head body so as to close said openings;

an X-shaped support portion extending from an end, begin an end of said crown portion along said openings and positioned on said face portion side, continuously in a direction away from said face portion to define part of said openings and supporting said crown part; and wherein the support portion is below the surface of the crown portion.

10. A golf club comprising the golf club head according to claim 9.

* * * * *